US011598331B2

(12) United States Patent
Gandhi et al.

(10) Patent No.: US 11,598,331 B2
(45) Date of Patent: Mar. 7, 2023

(54) ELECTROACTIVE POLYMER ACTUATOR FOR MULTI-STAGE PUMP

(71) Applicant: Toyota Motor Engineering & Manufacturing North America, Inc., Plano, TX (US)

(72) Inventors: Umesh N. Gandhi, Farmington Hills, MI (US); Ryohei Tsuruta, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 39 days.

(21) Appl. No.: 17/184,157

(22) Filed: Feb. 24, 2021

(65) Prior Publication Data

US 2022/0268268 A1 Aug. 25, 2022

(51) Int. Cl.
*F04B 43/09* (2006.01)
*F04B 53/10* (2006.01)
(Continued)

(52) U.S. Cl.
CPC ..... *F04B 43/09* (2013.01); *F04B 25/00* (2013.01); *F04B 53/00* (2013.01); *F04B 53/10* (2013.01)

(58) Field of Classification Search
CPC ..... F04B 25/00; F04B 43/00; F04B 43/0009; F04B 43/025; F04B 43/026; F04B 43/04;
(Continued)

(56) References Cited

U.S. PATENT DOCUMENTS 4,093,403 A * 6/1978 Schrimpf ..... F04B 43/026 417/246
7,353,747 B2 4/2008 Swayze et al.
(Continued)

FOREIGN PATENT DOCUMENTS

DE 102013009592 A1 * 12/2014 ..... F04B 35/04
EP 0884475 A2 * 12/1998 ..... F04B 43/02
FR 2648871 A1 * 12/1990 ..... F04B 15/02

OTHER PUBLICATIONS

Acome et al., "Hydraulically amplified self-healing electrostatic actuators with muscle-like performance," Science 259 (6371) p. 61-65 (2018).

(Continued)

*Primary Examiner* — Charles G Freay
*Assistant Examiner* — Chirag Jariwala
(74) *Attorney, Agent, or Firm* — Christopher G. Darrow; Darrow Mustafa PC

(57) ABSTRACT

A two-stage pump system is provided using electrostatic actuators. The system includes a pair of hydraulically-amplified, self-healing, electrostatic (HASEL) actuators in fluid communication with one another. Each actuator includes a deformable shell defining a working fluid compartment storing a dielectric fluid. Two electrodes are disposed on opposite sides of the deformable shell. A pair of fluid transfer bladders are disposed adjacent the respective pair of HASEL actuators, each including a fluid-impermeable membrane defining a transfer fluid chamber, and a biasing member disposed in the transfer fluid chamber. When individually actuated in an alternating two-stage pattern, the two electrodes of each respective HASEL actuator move from a neutral position to an attracted position, displacing dielectric fluid through the first transfer conduit
(Continued)

and between working fluid compartments, thereby pumping the transfer fluid from an inlet to an outlet.

20 Claims, 5 Drawing Sheets

(51) Int. Cl.
*F04B 53/00* (2006.01)
*F04B 25/00* (2006.01)

(58) Field of Classification Search
CPC .. F04B 43/043; F04B 43/046; F04B 43/0045; F04B 43/14; F04B 43/06; F04B 43/10; F04B 43/09; F04B 43/095; F04B 43/08; F04B 43/082; F04B 43/086; F04B 43/088; F04B 45/033; F04B 45/053; F04B 45/02; F04B 45/022; F04B 45/024; F04B 45/027; F04B 45/047
USPC ..... 417/246, 470, 473, 475, 521, 522; 310/300, 309
See application file for complete search history.

(56) References Cited

U.S. PATENT DOCUMENTS

| | | | | |
|---|---|---|---|---|
| 8,222,799 | B2 | 7/2012 | Polyakov et al. | |
| 9,061,118 | B2 | 6/2015 | Shoham et al. | |
| 2002/0114715 | A1* | 8/2002 | Yoon | F04B 43/06 417/393 |
| 2009/0115285 | A1 | 5/2009 | Najaf et al. | |
| 2011/0174400 | A1* | 7/2011 | Hong | F04B 43/0063 137/565.3 |
| 2020/0032822 | A1* | 1/2020 | Keplinger | F15B 15/08 |
| 2020/0132213 | A1 | 4/2020 | Gandhi et al. | |
| 2020/0378380 | A1* | 12/2020 | Okaguchi | F04B 49/03 |
| 2021/0075344 | A1* | 3/2021 | Ludois | H02N 1/002 |

OTHER PUBLICATIONS

Kellaris et al., "Peano-HASEL actuators: Muscle-mimetic, electrohydraulic transducers that linearly contract on activation," Sci. Robot, 3, eaar3276 (2018) 10 pages.
Mitchell et al., "An Easy-to-Implement Toolkit to Create Verastile and High-Performance HASEL Actuators for Untethered Soft Robots," Adv. Sci. 2019, 6, 1900178, 15 pages.

* cited by examiner

ELECTROACTIVE POLYMER ACTUATOR FOR MULTI-STAGE PUMP

TECHNICAL FIELD

The present disclosure generally relates to actuators and, more particularly, actuators that can operate two-stage pumps, and provide increased flow rates for multi-stage pumps.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Control systems can be employed for the actuation and positioning of a remote object or the like, including pneumatic, hydraulic, and electromechanical systems. These control systems can be used to control the movement of a variety of objects, such as autonomous devices, prosthetics, robotics, and inflatable structures. Each of these types of systems has particular advantages under certain conditions. Pneumatic systems can supply force through the delivery of a compressed gas, whereas hydraulic systems rely on minimally compressible liquids. Furthermore, high pressures can be employed which reduces the size of the operating equipment. However, hydraulic fluids are often not fire proof, and hydraulic systems may be susceptible to leakage and high maintenance, particularly in control applications. Electromechanical systems rely on electrically moveable components, and can include combinations of the previous systems (e.g., electro-pneumatic and electro-hydraulic systems).

Hydraulically-amplified, self-healing, electrostatic (HASEL) actuators use electric fields and hydraulic forces to locally displace a liquid dielectric material that is generally enclosed in a soft hydraulic architecture. For example, electrostatic forces between electrode pairs of the actuators (generated upon application of a voltage to the electrode pairs) draws the electrodes in each pair towards each other, displacing the liquid dielectric to drive actuation in various manners. However, losses in speed, pressure, and efficiency associated with transporting fluid through such an architecture may limit certain applications. Accordingly, there remains a need for more robust designs of actuators.

SUMMARY

This section provides a general summary of the disclosure, and is not a comprehensive disclosure of its full scope or all of its features.

In various aspects, the present teachings provide a two-stage pump system using electrostatic actuators. The two-stage pump system includes a pair of hydraulically-amplified, self-healing, electrostatic (HASEL) actuators. Each HASEL actuator is in fluid communication with one another, and includes a deformable shell defining a working fluid compartment. A dielectric fluid is disposed in the working fluid compartment. Two electrodes are disposed on opposite sides of the deformable shell. A first transfer conduit is provided, enabling two-way fluid communication between the working fluid compartments of the pair of HASEL actuators. The two-stage pump system also includes a pair of fluid transfer bladders disposed adjacent the respective pair of HASEL actuators. Each fluid transfer bladder is configured for pumping a transfer fluid from an inlet to an outlet, and includes a fluid-impermeable membrane defining a transfer fluid chamber. A biasing member is disposed in the transfer fluid chamber. A second transfer conduit is provided, enabling selective fluid communication between the pair of fluid transfer bladders. When individually actuated in an alternating two-stage pattern, the two electrodes of each respective HASEL actuator move from a neutral position to an attracted position, displacing dielectric fluid through the first transfer conduit and between working fluid compartments, thereby pumping the transfer fluid from the inlet to the outlet.

In other aspects, the present teachings provide a continuous pump system using electrostatic actuators. The continuous pump system includes a plurality of two-stage pumps coupled in a parallel manner to a common fluid conduit. Each two-stage pump includes a pair HASEL actuators. Each HASEL actuator is in fluid communication with one another, and includes a deformable shell defining a working fluid compartment. A dielectric fluid is disposed in the working fluid compartment. Two electrodes are disposed on opposite sides of the deformable shell. A first transfer conduit is provided, enabling two-way fluid communication between the working fluid compartments of the pair of HASEL actuators. The two-stage pump system also includes a pair of fluid transfer bladders disposed adjacent the respective pair of HASEL actuators. Each fluid transfer bladder is configured for pumping a transfer fluid from an inlet to an outlet, and includes a fluid-impermeable membrane defining a transfer fluid chamber. A biasing member is disposed in the transfer fluid chamber. A second transfer conduit is provided, enabling selective fluid communication between the pair of fluid transfer bladders. When individually actuated in an alternating two-stage pattern, the two electrodes of each respective HASEL actuator move from a neutral position to an attracted position, displacing dielectric fluid through the first transfer conduit and between working fluid compartments, thereby pumping the transfer fluid from the inlet to the outlet. Each of the plurality of two stage pumps is configured to alternatingly output fluid to the common fluid conduit.

In still other aspects, the present teachings provide a multi-stage pump system using electrostatic actuators. The multi-stage pump system includes a plurality of two-stage pumps coupled in a stacked series manner and configured to increase a pressure along a common fluid conduit. Each two-stage pump includes a pair HASEL actuators. Each HASEL actuator is in fluid communication with one another, and includes a deformable shell defining a working fluid compartment. A dielectric fluid is disposed in the working fluid compartment. Two electrodes are disposed on opposite sides of the deformable shell. A first transfer conduit is provided, enabling two-way fluid communication between the working fluid compartments of the pair of HASEL actuators. The two-stage pump system also includes a pair of fluid transfer bladders disposed adjacent the respective pair of HASEL actuators. Each fluid transfer bladder is configured for pumping a transfer fluid from an inlet to an outlet, and includes a fluid-impermeable membrane defining a transfer fluid chamber. A biasing member is disposed in the transfer fluid chamber. A second transfer conduit is provided, enabling selective fluid communication between the pair of fluid transfer bladders. When individually actuated in an alternating two-stage pattern, the two electrodes of each respective HASEL actuator move from a neutral position to an attracted position, displacing dielectric fluid through the first transfer conduit and between working fluid compartments, thereby pumping the transfer fluid from the inlet to the outlet. Each of the plurality of two stage pumps is configured to output fluid to the common fluid conduit.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The various aspects disclosed herein generally relate to a liquid electroactive polymer (EAP) actuator for the operation of soft pumps. In particular, the present teachings provide a soft, two-stage pump system using electrostatic actuators. The two-stage pump system includes a pair of hydraulically-amplified, self-healing, electrostatic (HASEL) actuators. Each HASEL actuator of the pair is in fluid communication with one another, and includes a deformable shell defining a working fluid compartment. A dielectric fluid is disposed in the working fluid compartment. Two electrodes are disposed on opposite sides of each deformable shell. A first transfer conduit is provided, enabling two-way fluid communication between the working fluid compartments of the pair of HASEL actuators. The two-stage pump system also includes a pair of fluid transfer bladders disposed adjacent the respective pair of HASEL actuators. Each fluid transfer bladder is configured for pumping a transfer fluid from an inlet to an outlet, and includes a fluid-impermeable membrane defining a transfer fluid chamber. A biasing member is disposed in the transfer fluid chamber. A second transfer conduit is provided, enabling selective fluid communication between the pair of fluid transfer bladders. When individually actuated in an alternating two-stage pattern, the two electrodes of each respective HASEL actuator move from a neutral position to an attracted position, displacing dielectric fluid through the first transfer conduit and between working fluid compartments, thereby pumping the transfer fluid from the inlet to the outlet. High flow rates can be achieved by using complementary, or multi-stage (a series of at least two), soft pumps for a continuous flow.

Figure 1:
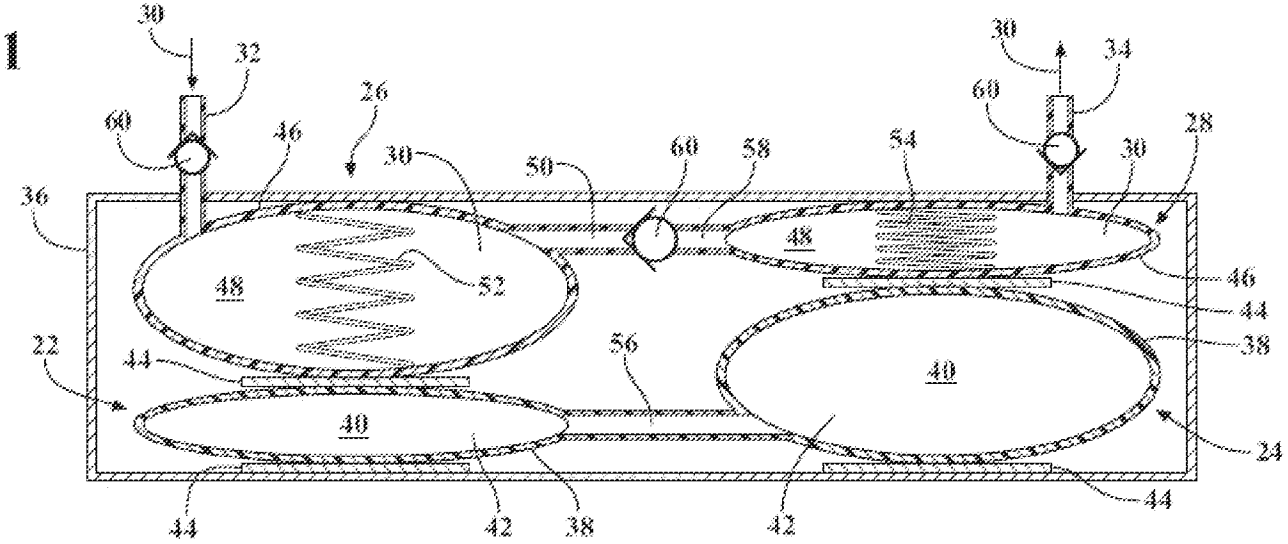
FIG. 1 illustrates a schematic illustration of an exemplary two-stage pump with the pairs of electrodes in a first configuration according of the present technology.
Figure 2:
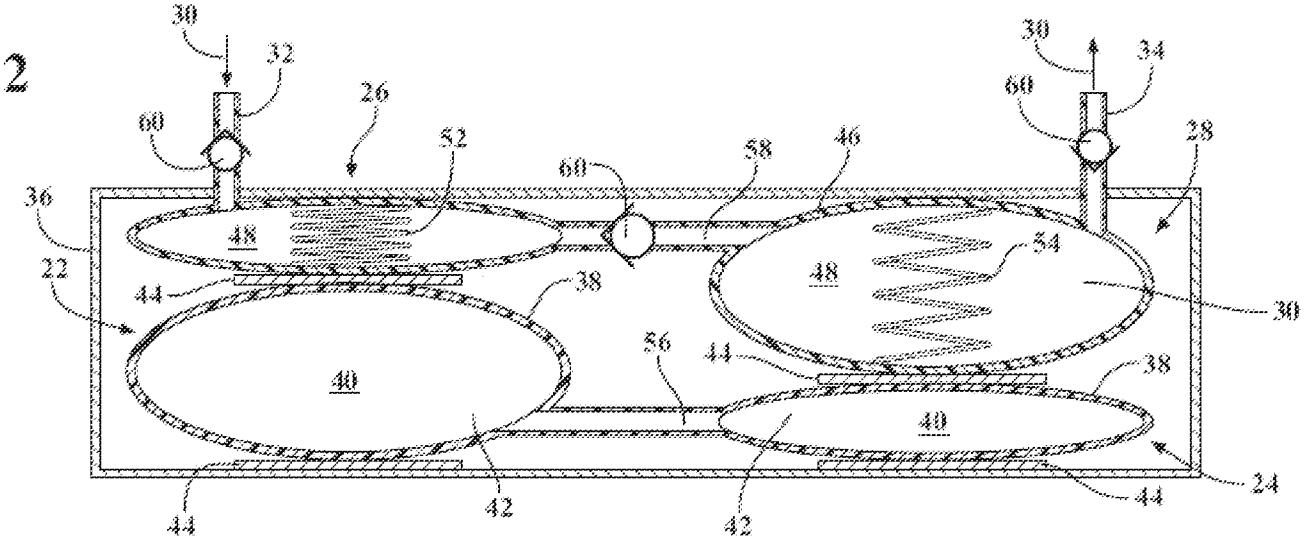
FIG. 2 illustrates a schematic illustration of the exemplary two-stage pump of FIG. 1, with the pairs of electrodes in a second configuration according of the present technology.

FIGS. 1-2 provide a basic schematic illustration of the operation of an exemplary two-stage pump according to various aspects of the present technology. As shown, the two-stage pump 20 includes a pair of HASEL actuators 22, 24 and a pair of fluid transfer bladders 26, 28 configured for pumping a transfer fluid 30 between an inlet 32 and an outlet 34. In various aspects, the two-stage pump 20 may optionally be contained within a suitable housing 36, or enclosure. Pumping of the transfer fluid 30 can provide a pressurized transfer fluid capable of pnuematically operating various types of robotic devices as are known in the art, and the specific operations are not meant to be limiting in any manner. In various non-limiting aspects, the transfer fluid 30 can be a liquid, such as water, or a gas, such as air.

As shown in FIGS. 1-2, each HASEL actuator 22, 24 can include an outer, deformable shell 38, such as a flexible casing or shaped bladder, that defines a working fluid compartment 40, or cavity, configured to retain a working fluid, such as a dielectric fluid 42. Two electrodes 44, or electrical conductors, are disposed on opposite sides of the deformable shell. The electrodes 44 may be in electrical connection with an appropriate controller and power supply (not specifically shown) that is configured to provide high voltage at a low current, for example, in the microamp range. Generally, the electrodes 44 as used herein can be of a shape and material such that they can receive a suitable voltage from the controller/power supply. The voltage delivered through the electrodes 44 can be either constant or varying over time.

In various aspects, the controller(s) may be configured to control and operate a plurality of two-stage pumps in different phases, as well as control and operate a plurality of two-stage pumps arranged in a series or stacked series manner in order to successively increase a pressure of the transfer fluid. For example, the electrodes 44 of the HASEL actuators 22, 24 have a deactivated state, such that the electrodes 44 do not compress the deformable shells 38. When power is supplied to the electrodes 44, it causes an electrostatic attraction, where the electrodes 44 move toward each other, to have an activated state. When the electrodes 44 move toward one another in the activated state, dielectric fluid 42 is displaced in a lateral direction, out of the working fluid compartment 40 and into an adjacent actuator. When the electrodes 44 move away from one another in the deactivated state (no applied current), the dielectric fluid 42 is returned from the adjacent actuator into the original working fluid compartment 40. Switching between the deactivated and activated states causes a pumping action that moves the transfer fluid. The implementations disclosed herein are described in more detail with reference to the figures herein.

Figure 3:
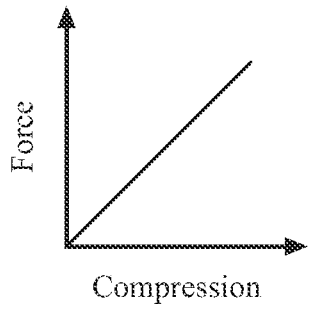
FIG. 3 is a representative chart illustrating a resulting spring constant $K_1$ for a compression type of biasing member, such as a spring.
Figure 4:
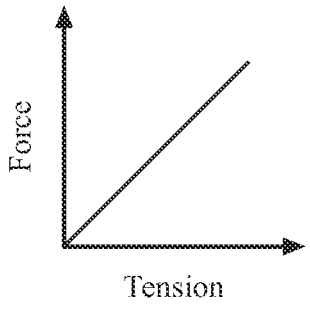
FIG. 4 is a representative chart illustrating a resulting spring constant $K_2$ for a tension type of biasing member, such as a rubber band.

Each of the fluid transfer bladders 26, 28 may be disposed adjacent a respective pair of HASEL actuators 22, 24. For example, the first fluid transfer bladder 26 is shown adjacent to and controlled by the first HASEL actuator 22, and the second fluid transfer bladder 28 is shown adjacent to and controlled by the second HASEL actuator 24. In certain aspects, each fluid transfer bladder 26, 28 may be physically coupled to a respective one of the pair of HASEL actuators 22, 24. The fluid transfer bladders 26, 28 may include a fluid-impermeable membrane 46 that defines a transfer fluid chamber 48 and contains the transfer fluid 30. At least one biasing member 52, 54 may be disposed in each respective fluid transfer bladder 26, 28. In various aspects, one of the biasing members 52 may be a compressive biasing member, such as a spring or the like, having a first spring constant $K_1$, while the other biasing member 54 may be provided to exhibit a tensile biasing force, such as a rubberband or the like, having a second spring constant $K_2$. Different combinations of biasing members may be used depending on the specific design. In most instances, each biasing member 52, 54 will have a different spring constant associated therewith. FIG. 3 is a representative chart illustrating a resulting spring constant $K_1$ for a compression type of biasing member, such as a spring. FIG. 4 is a representative chart illustrating a resulting spring constant $K_2$ for a tension type of biasing member, such as a rubber band.

A first transfer conduit 56 may be included, providing two-way fluid communication between the respective working fluid compartments 40 of the pair of HASEL actuators 22, 24. Similarly, a second transfer conduit 58 can be including, providing selective fluid communication between the respective transfer fluid chambers 48 of the fluid transfer bladders 26, 28. It should be understood that the specific shapes and sizes of the HASEL actuators 22, 24, the fluid transfer bladders 26, 28, and the fluid transfer conduits 56, 58 may vary, and the shapes and relative dimensions provided in the figures are for illustrative purposes. A number of one-way valves 60, or check valves, may be provided at certain locations. For example, a one way valve 60 may be provided adjacent the inlet 32, adjacent the outlet 34, and adjacent or within the second transfer conduit 58 in order to selectively control the direction of flow, and to prevent backflow of the transfer fluid 30.

Operation of the two-stage pumps 20 can be best understood with reference to the differences in stages between FIG. 1 and FIG. 2. For example, FIG. 1 illustrates a schematic illustration of a first stage, with the pairs of electrodes 44 in a first configuration. FIG. 2 illustrates a schematic illustration of a second stage, with the pairs of electrodes 44 in a second configuration.

When alternating from the first stage shown in FIG. 1 to the second stage shown in FIG. 2, current is removed from the electrodes 44 of the first actuator 22, removing their attraction to one another, and current is applied to the electrodes 44 of the second actuator 24, causing the electrodes 44 to attract. In this regard, dielectric fluid 42 is transferred from the working fluid compartment 40 of the second actuator 24 through the first transfer conduit 56 and to the working fluid compartment 40 of the first actuator 22. At the same time, this causes the transfer fluid 30 to move from the first fluid transfer bladder 26 through the second transfer conduit 58 and into the second fluid transfer bladder 28. This also energizes both biasing members 52, 54, with the first biasing member 52 now being compressed, and the second biasing member 54 being stretched, as shown in FIG. 2. There is no flow of the working fluid 30 out of the two-stage pump when alternating from the first stage to the second stage.

When alternating from the second stage shown in FIG. 2 back to the first stage shown in FIG. 1, current is removed from the electrodes 44 of the second actuator 24, removing their attraction to one another, and current is applied to the electrodes 44 of the first actuator 22, causing the electrodes 44 to attract. The expansion and contraction of the respective deformable shells 38 and fluid-impermeable membranes 46 is assisted by the biasing members 52, 54, with the first biasing member 52 now expanding, and the second biasing member 54 returning to its relaxed state, as shown in FIG. 1. The dielectric fluid 42 is transferred from the working fluid compartment 40 of the first actuator 22 through the first transfer conduit 56 and to the working fluid compartment 40 of the second actuator 24. At the same time, this causes the transfer fluid 30 to move from the second fluid transfer bladder 28 through to the outlet 34. A one-way valve 60 prevents the working fluid from moving from the second fluid transfer bladder 28 back to the first fluid transfer bladder 26. Additionally, working fluid 30 is now moved into the first fluid transfer bladder 26 from the inlet 32.

Figure 5:
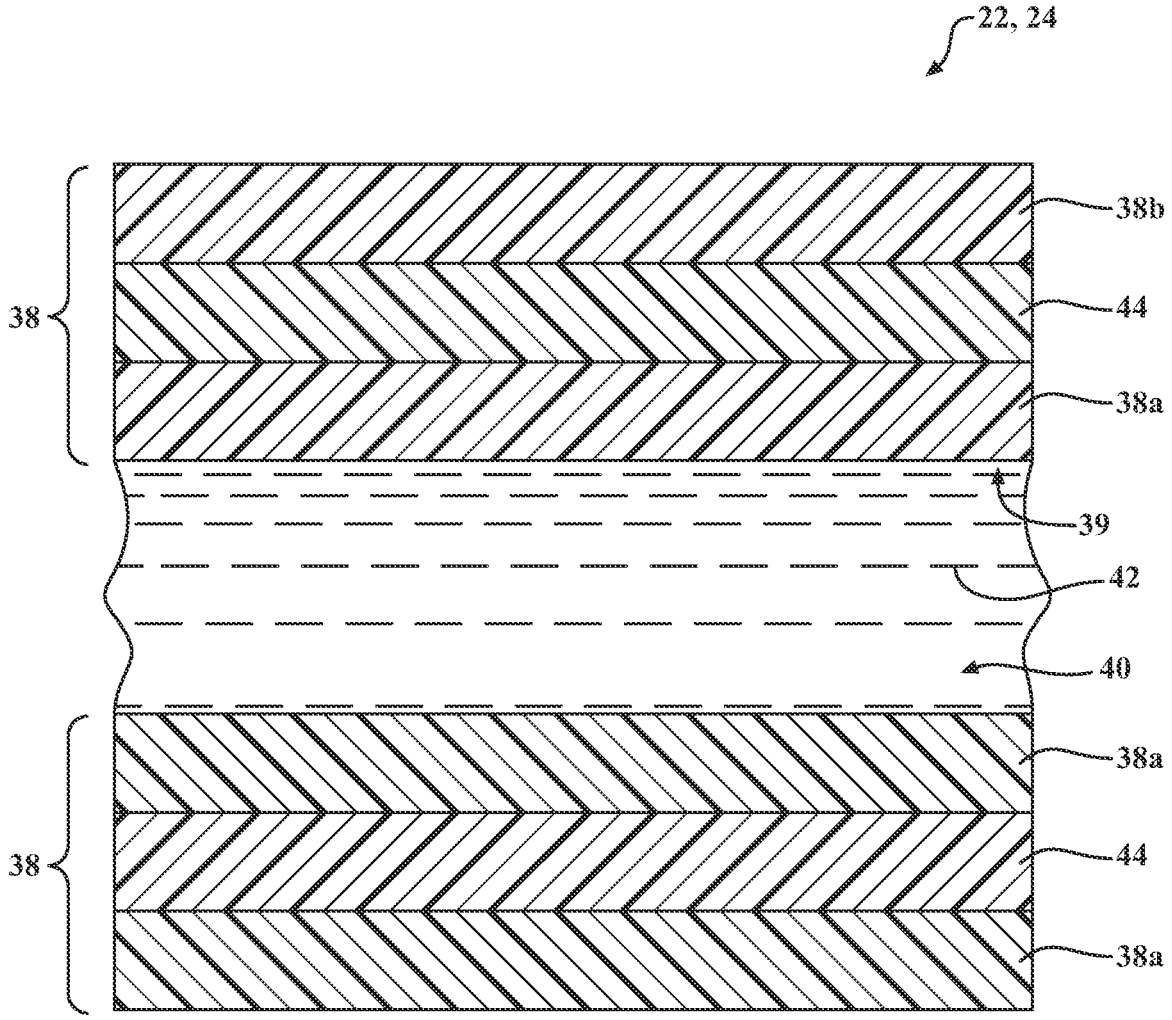
FIG. 5 is a magnified, partial cross-sectional view of an actuator, such as that provided in FIG. 1, according to a first configuration, with an electrode disposed at least partially within the deforamable shell.

FIG. 5 is a magnified partial cross sectional view of one exemplary actuator 22, 24 with an electrode 44 disposed at least partially within the deforamable shell 38. The actuators 22, 24 can be soft, in that they can generally have a pliable or semi-pliable body. The actuators 22, 24 can be broadly described as an electrostatic device capable of displacing and/or affecting the flow of a fluid with the application of electric charge. As discussed above, the application of an electric charge can be used to attract two or more conductive elements together into an actuated position. An "actuated position," as used herein, relates to the ability of the actuators 22, 24 to use electrostatic attraction to bring the inner surfaces 39 of the deformable shell 38 together, thus creating hydraulic force. In one or more implementations, the actuated position is achieved by delivering an electrical input to the conductive portions of the fluid-impermeable membrane, as described herein. A "relaxed position," as used herein, refers to the actuator 22, 24 being in a state of low entropy, without input from electrostatic attraction creating a hydraulic force in the deformable shell 38. In one or more implementations, the relaxed position is the original shape of the deformable shell 38, in response to stopping the electrical input to the conductive electrode portions. The actuators 22, 24 can be capable of changing shape in the presence of the electric charge, causing fluid pressure to be applied to the components of the deformable shell 38. This fluid pressure can then change the shape of the actuator 22, 24, in relation to the elasticity of the deformable shell 38. Thus, the actuator 22, 24 has a first shape that is maintained in the absence of an electrical input. The electric charge to the actuator 22, 24 can then be delivered, causing the actuator 22, 24 to achieve to a second state due to hydraulic forces. When the charge is removed, the actuator 22, 24 can then return to the first shape.

As shown in FIG. 5, deformable shell 38, or membrane, can be composed of layers, such as an external portion **38*b*, an electrode, and an internal portion 38*a* having a surface 39 defining the working fluid compartment 40 to contain the dielectric fluid 42. The internal and/or external portions may be insulators, or have insulating properties. A "portion," as used herein, relates to one or more components that form a layer, a portion of a layer, or structure in the deformable shell 38 of the actuator 22, 24. The portions can have non-uniform coverage or thickness, as desired. The portions above are described as a single, uniform element or layer for simplicity purposes. However, the portions can include one or more of any of the layers, portions of layers, or variations as disclosed herein. As such, the portions may only partially extend the dimensions of the deformable shell 38. As well, the portions of the deformable shell can meet to form a seal, such that the working fluid compartment 40 is formed by the internal portion 38***a* of the deformable shell 38.

The deformable shell 38, as well as portions 38*a*, 38*b* thereof, and can include a polymer, an elastomeric polymer (elastomer) or both. In various aspects, the deformable shell 38 includes an electroactive polymer (EAP). The use of a plurality of different encapsulating elastomers and/or polymers of varying degrees of softness and hardness can be employed. The polymers used in the implementations described herein can further include the addition of a plasticizer, such as phthalate esters. The polymers or elastomers may be natural or synthetic. Examples of elastomers usable as part of an external insulating portion can include an insulating elastomer, such as nitrile, ethylene propylene diene monomer (EPDM), fluorosilicone (FVMQ), vinylidene fluoride (VDF), hexafluoropropylene (HFP), tetrafluoroethylene (TFE), perfluoromethylvinylether (PMVE), polydimethylsiloxane (PDMS), natural rubber, neoprene, polyurethane, silicone, silicone rubber, or combinations thereof. Any external insulating portion can be described with regard to electrical insulation. The electrical insulation of any external insulating portion can be described in relation to the dielectric constant, or κ value, of said material, such as having a higher or lower dielectric constant. The term "elastomer," as used herein, means a material which can be stretched by an external force at room temperature to at least twice its original length, and then upon immediate release of the external force, can return to its original length. Room temperature can generally refer to a temperature in a range of from about 20° C. to about 25° C. Elastomers, as used herein, can include a thermoplastic, and may be cross-linked or thermoset.

In various aspects, the electrodes 44, or portions thereof, are conductive to electrical current, such that the electrodes 44 create an electric field. In certain aspects, conducting portions can include hydrogels, and can further include a polymer, an elastomeric polymer (elastomer) or both. Examples of elastomers usable as part of the conducting portions can include nitrile, EPDM, fluorosilicone (FVMQ), vinylidene fluoride (VDF), hexafluoropropylene (HFP), tetrafluoroethylene (TFE), perfluoromethylvinylether (PMVE), polydimethylsiloxane (PDMS), natural rubber, neoprene, polyurethane, silicone, or combinations thereof. The conducting portions can be composed or further include a conductive material, such as an electrically conductive dopant. Electrically conductive dopants can include silver, gold, platinum, copper, aluminum, or others. In further implementations, the conducting portions can include inks and adhesives, for the purpose of flexibility and/or conductivity.

The dielectric fluid 42 can be a fluid that is resistant to electrical breakdown and/or provides insulation. In one or more implementations, the dielectric fluid 42 can prevent arcing between one or more opposing layers or portions of the deformable shell 38. The dielectric fluid 42 can be a lipid based fluid, such as a vegetable oil-based dielectric fluid. In one implementation, the dielectric fluid 42 can be ethylene glycol. The dielectric fluid 42 can be selected based on desired dielectric constant, or κ value.

Materials suitable for use as an electroactive polymer (EAP), in the one or more implementations described herein, can include any insulating polymer or rubber (or a combination thereof) that deforms in response to an electrostatic force or whose deformation results in a change in electric field. Exemplary materials suitable for use as an electroactive polymer can include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers, such as those including silicone and acrylic moieties, can include copolymers having silicone and acrylic moieties, polymer blends having a silicone elastomer and an acrylic elastomer, or others. Combinations of some of these materials may also be used. Materials used as an electroactive polymer can be selected based on one or more material properties. Material properties used for selection can include a high electrical breakdown strength, a low modulus of elasticity (such as for controlling the level of deformation), or others.

Figure 6:
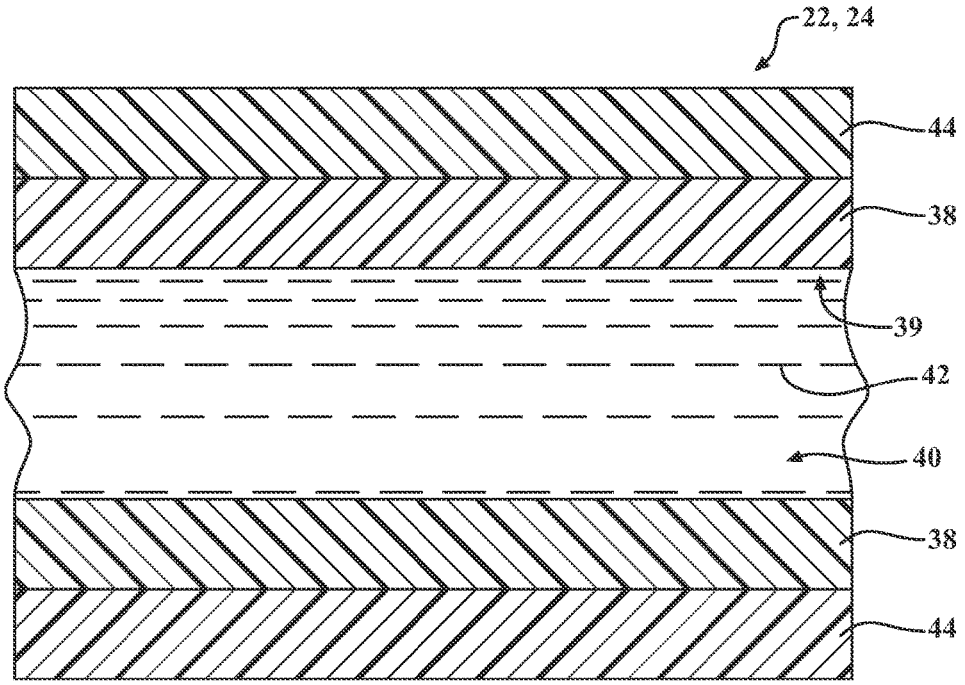
FIG. 6 is a magnified, partial cross-sectional view of an actuator, such as that provided in FIG. 1, according to a second configuration, with an electrode disposed adjacent an exterior of the deformable shell of an actuator.

FIG. 6 is a magnified, partial cross-sectional view of an actuator 22, 24, such as that provided in FIG. 1, according to a second configuration, with an electrode disposed adjacent an exterior of the deformable shell 38. In various aspects, the electrodes 44 can be flexible or malleable electrodes, and can be coated over at least a portion of the deformable shell 38. In this regard, the electrodes 44 can be capable of deforming or deflecting without compromising mechanical or electrical performance.

Figure 7:
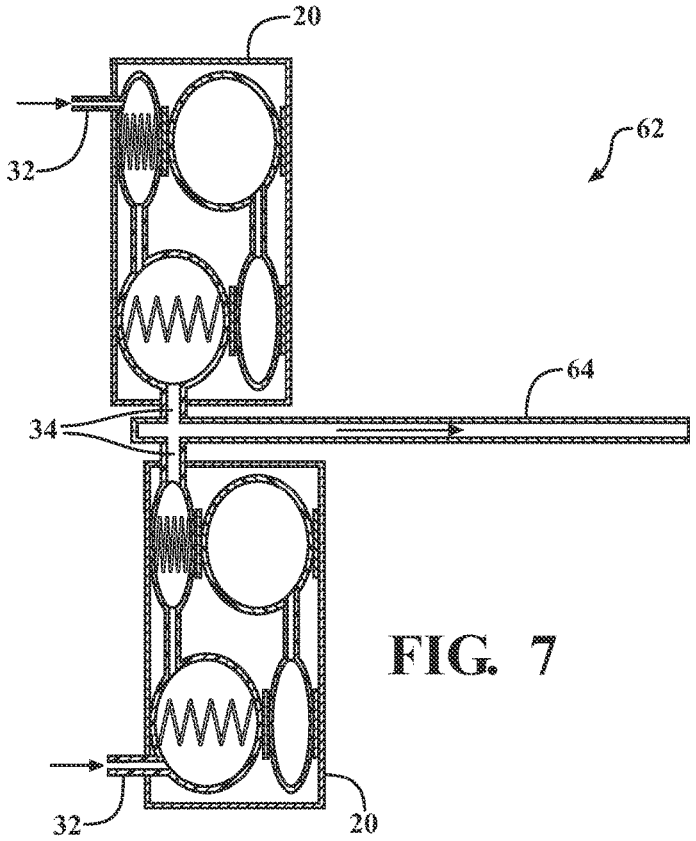
FIG. 7 illustrates a schematic illustration of an exemplary continuous pump system using a plurality of two-stage pumps coupled in a parallel manner to a common fluid conduit.
Figure 8:
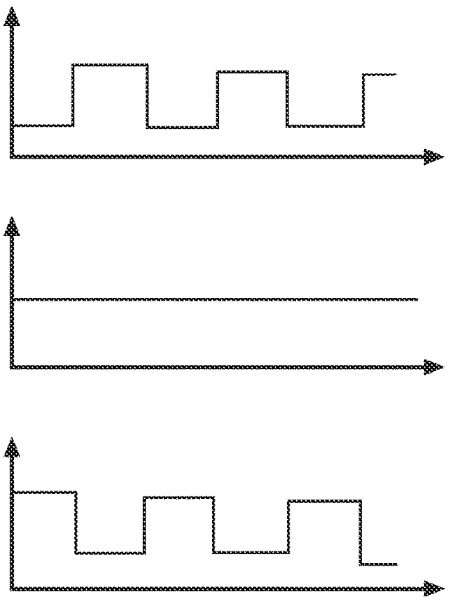
FIG. 8 graphically illustrates a two phase operation of the two stage pumps configured to alternatingly output fluid to the common fluid conduit, thereby providing a combined output analogous to a continuous flow.

FIG. 7 illustrates a schematic illustration of an exemplary continuous pump system 62 using a plurality of two-stage pumps 20 coupled in a parallel manner to a common fluid conduit 64 that can be used to circulate a transfer fluid 30. FIG. 8 graphically illustrates a two phase operation of two individual two-stage pumps configured to alternatingly output fluid to the common fluid conduit 64 (upper and lower graphs), thereby providing a combined output represented in the center graph. The continuous pump system can be operated by a suitable controller such that the combined output is analogous to a continuous flow. In various aspects, each two-stage pump 20 will provide a similar volume output of the transfer fluid 30, and at the same pressure in order to provide the continuous flow of the transfer fluid 30. Check valves may be useful, for example, at the pump outlets 34, depending upon the specific design and location of the two-stage pumps 20 with respect to each other.

Figure 9:
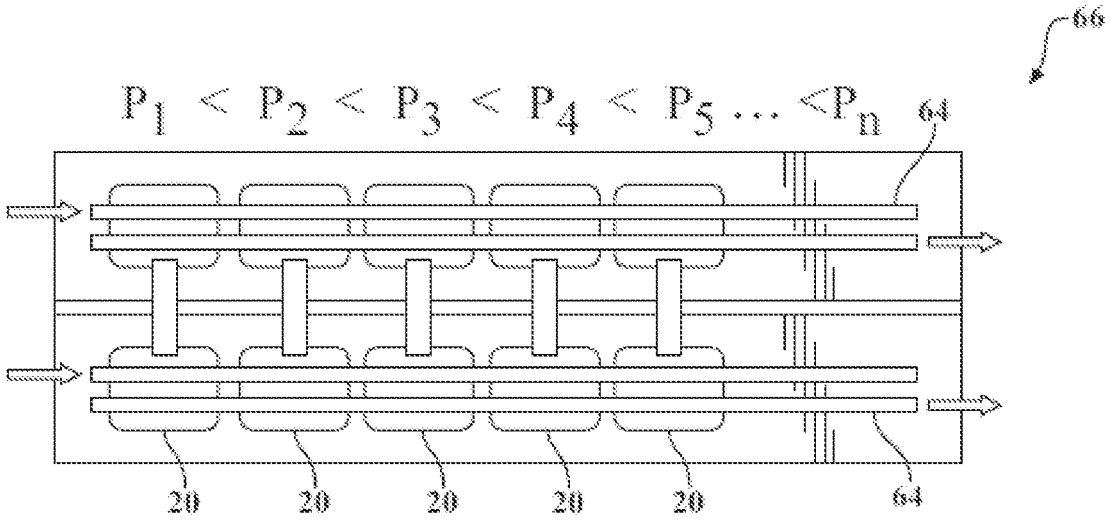
FIG. 9 illustrates a schematic illustration of a first exemplary multi-stage pump system including a plurality of two-stage pumps coupled in a stacked series manner and configured to increase a pressure along a common fluid conduit.

FIG. 9 illustrates a schematic illustration of a first exemplary multi-stage type of pump system 66 that includes a plurality of two-stage pumps coupled in a stacked series manner. With this type of arrangement, the system 66 can be configured to increase a pressure along one or more common fluid conduits 64. For example, as shown in FIG. 9, the pressure increases from $P_1$ up to $P_n$, where n is the number of two-stage pumps in the series. In certain aspects, the number of pumps, n, in the series can be greater than 4, greater than 6, greater than 8, and even greater than 10.In various aspects, the two-stage pumps 20 may be controlled such that the increase in pressure between adjacent pumps can be from about a 5% to about a 20% increase in the common fluid conduit after passing pump 20 in the stacked series. This can result in a system configured to output the transfer fluid 30 at a pressure of between about 3 to about 5 psi, or even greater.

Figure 10:
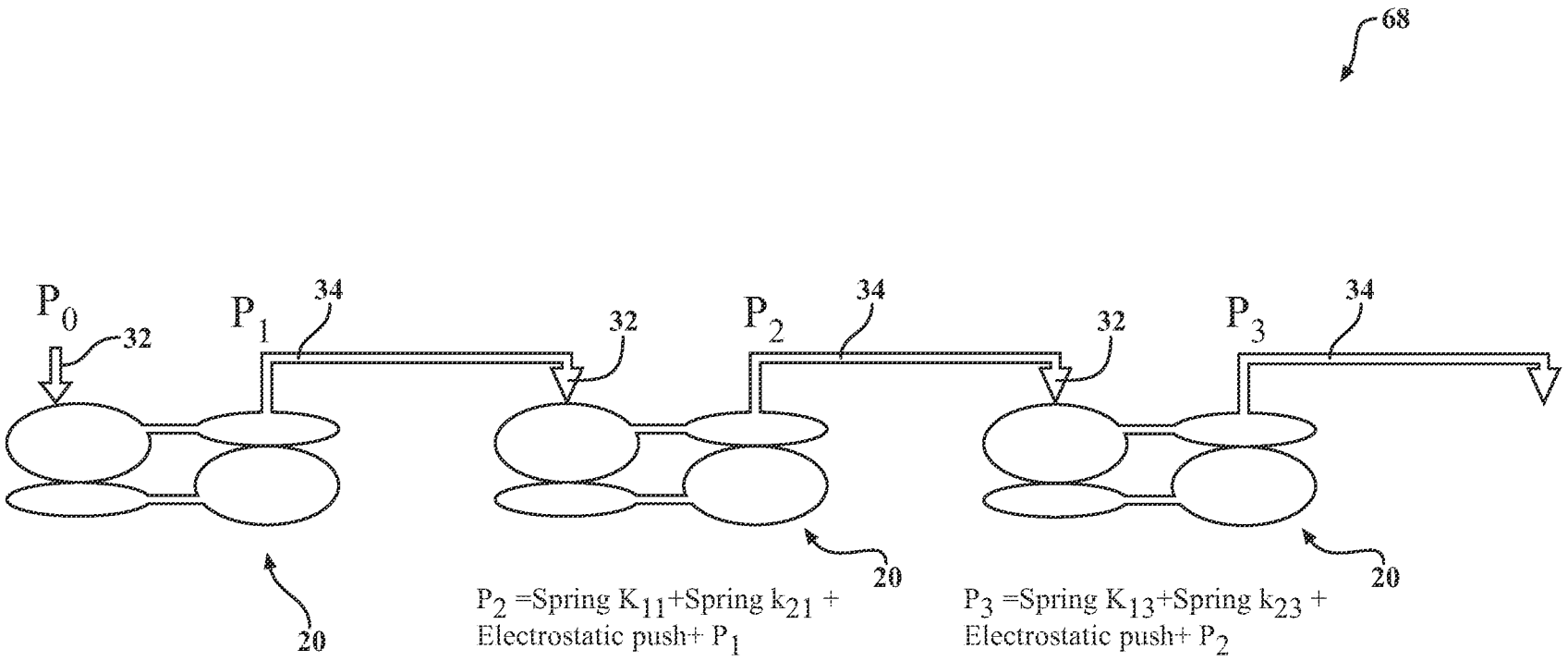
FIG. 10 illustrates a schematic illustration of a second exemplary multi-stage pump system including a plurality of two-stage pumps coupled in a series manner and configured to increase a pressure of a transfer fluid.

FIG. 10 illustrates a schematic illustration of a second exemplary multi-stage pump system 68 including a plurality of two-stage pumps 20 coupled in a series manner such that the outlet 34 of each pump 20 is connected to the inlet 32 of the next pump 20 in the series, such that the system 68 is configured to successively increase a pressure of a transfer fluid. In order to accomplish such an increase, the spring constants of the biasing members would need to increase with the increased pressure. For example, the downstream biasing members of the plurality of two-stage pumps 20 would be provided with sequentially increasing spring constants associated therewith.

In the description above, certain specific details are outlined in order to provide a thorough understanding of various implementations. However, one skilled in the art will understand that the invention may be practiced without these details. In other instances, well-known structures have not been shown or described in detail to avoid unnecessarily obscuring descriptions of the implementations. Unless the context requires otherwise, throughout the specification and claims which follow, the word "comprise" and variations thereof, such as, "comprises" and "comprising" are to be construed in an open, inclusive sense, that is, as "including, but not limited to." Further, headings provided herein are for convenience only and do not interpret the scope or meaning of the claimed invention.

Reference throughout this specification to "one or more implementations" or "an implementation" means that a particular feature, structure or characteristic described in connection with the implementation is included in at least one or more implementations. Thus, the appearances of the phrases "in one or more implementations" or "in an implementation" in various places throughout this specification are not necessarily all referring to the same implementation. Furthermore, the particular features, structures, or characteristics may be combined in any suitable manner in one or more implementations. Also, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Detailed implementations are disclosed herein. However, it is to be understood that the disclosed implementations are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various implementations are shown in FIGS. 1-10, but the implementations are not limited to the illustrated structure or application.

The flowcharts and block diagrams in the figures illustrate the architecture, functionality, and operation of possible implementations of systems, methods, devices, and computer program products according to various implementations. In this regard, each block in the flowcharts or block diagrams can represent a module, segment, or portion of code, which can include one or more executable instructions for implementing the specified logical function(s). It should also be noted that, in some alternative implementations, the functions noted in the block can occur out of the order noted in the figures. For example, two blocks shown in succession can, in fact, be executed substantially concurrently, or the blocks can sometimes be executed in the reverse order, depending upon the functionality involved.

The systems, components and/or methods described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or methods also can be embedded in a computer-readable storage, such as a computer program product or other data programs storage device, readable by a machine, tangibly embodying a program of instructions executable by the machine to perform methods and methods described herein. These elements also can be embedded in an application product which can include all the features enabling the implementation of the methods described herein and, which when loaded in a processing system, can carry out these methods.

The headings (such as "Background" and "Summary") and sub-headings used herein are intended only for general organization of topics within the present disclosure and are not intended to limit the disclosure of the technology or any aspect thereof. The recitation of multiple implementations having stated features is not intended to exclude other implementations having additional features, or other implementations incorporating different combinations of the stated features. As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an implementation can or may comprise certain elements or features does not exclude other implementations of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an implementation or particular system is included in at least one or more implementations or aspect. The appearances of the phrase "in one aspect" (or variations thereof) are not necessarily referring to the same aspect or implementation. It should also be understood that the various method steps discussed herein do not have to be carried out in the same order as depicted, and not each method step is required in each aspect or implementation.

The terms "a" and "an," as used herein, are defined as one as or more than one. The term "plurality," as used herein, is defined as two or more than two. The term "another," as used herein, is defined as at least a second or more. The terms "including" and/or "having," as used herein, are defined as including (i.e., open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g., AB, AC, BC or ABC).

The preceding description of the implementations has been provided for purposes of illustration and description. It is not intended to be exhaustive or to limit the disclosure. Individual elements or features of a particular implementation are generally not limited to that particular implementation, but, where applicable, are interchangeable and can be used in a selected implementation, even if not specifically shown or described. The same may also be varied in many ways. Such variations should not be regarded as a departure from the disclosure, and all such modifications are intended to be included within the scope of the disclosure.

While the preceding is directed to implementations of the disclosed devices, systems, and methods, other and further implementations of the disclosed devices, systems, and methods can be devised without departing from the basic scope thereof. The scope thereof is determined by the claims that follow.

What is claimed is:

1. A two-stage pump system using electrostatic actuators, the two-stage pump system comprising:

a pair of hydraulically-amplified, self-healing, electrostatic (HASEL) actuators, each HASEL actuator of the pair of HASEL actuators in fluid communication with one another, and comprising:

a deformable shell defining a working fluid compartment;

a dielectric fluid disposed in the working fluid compartment; and two electrodes disposed on opposite sides of the deformable shell;

a first transfer conduit providing two-way fluid communication between the working fluid compartments of the pair of HASEL actuators;

a pair of fluid transfer bladders disposed adjacent the pair of HASEL actuators, each fluid transfer bladder of the pair of fluid transfer bladders configured for pumping a transfer fluid from an inlet to an outlet, and comprising:

a fluid-impermeable membrane defining a transfer fluid chamber; and a biasing member disposed in the transfer fluid chamber; and a second transfer conduit providing selective fluid communication between the pair of fluid transfer bladders, wherein when individually actuated in an alternating two-stage pattern, the two electrodes of each respective HASEL actuator of the pair of HASEL actuators move from a neutral position to an attracted position, displacing the dielectric fluid through the first transfer conduit and between working fluid compartments of the pair of HASEL actuators, thereby pumping the transfer fluid from the inlet to the outlet.

2. The two-stage pump system according to claim 1, wherein the deformable shell comprises an electroactive polymer.

3. The two-stage pump system according to claim 1, wherein the two electrodes are flexible electrodes coated over at least a portion of the deformable shell.

4. The two-stage pump system according to claim 1, wherein the two electrodes are disposed within the deformable shell, and at least a portion of the deformable shell is an insulating portion containing one or more polymers.

5. The two-stage pump system according to claim 1, wherein each biasing member of the pair of fluid transfer bladders has a different spring constant associated therewith.

6. The two-stage pump system according to claim 1, wherein each fluid transfer bladder of the pair of fluid transfer bladders is physically coupled to a respective HASEL actuator of the pair of HASEL actuators.

7. The two-stage pump system according to claim 1, wherein the second transfer conduit comprises a one-way valve to prevent backflow of the transfer fluid.

8. The two-stage pump system according to claim 1, wherein the transfer fluid comprises a gas.

9. A continuous pump system using electrostatic actuators, the continuous pump system comprising:

a plurality of two-stage pumps coupled in a parallel manner to a common fluid conduit, each two-stage pump of the plurality of two-stage pumps comprising:

a pair of hydraulically-amplified, self-healing, electrostatic (HASEL) actuators, each HASEL actuator of the pair of HASEL actuators in fluid communication with one another, and comprising:

a deformable shell defining a working fluid compartment;

a dielectric fluid disposed in the working fluid compartment; and two electrodes disposed on opposite sides of the deformable shell;

a first transfer conduit providing two-way fluid communication between the working fluid compartments of the pair of HASEL actuators;

a pair of fluid transfer bladders disposed adjacent the pair of HASEL actuators, each fluid transfer bladder of the pair of fluid transfer bladders configured for pumping a transfer fluid from an inlet to an outlet, wherein the outlet is in fluid communication with the common fluid conduit and wherein each fluid transfer bladder of the pair of fluid transfer bladders comprising:

a fluid-impermeable membrane defining a transfer fluid chamber; and a biasing member disposed in the transfer fluid chamber; and a second transfer conduit providing selective fluid communication between the pair of fluid transfer bladders, wherein each two-stage pump of the plurality of two stage pumps is configured to alternatingly output the transfer fluid to the common fluid conduit.

10. The continuous pump system according to claim 9, wherein each fluid transfer bladder of the pair of fluid transfer bladders is physically coupled to a respective HASEL actuator of the pair of HASEL actuators.

11. The continuous pump system according to claim 9, wherein the outlet comprises a one-way valve to prevent backflow of the transfer fluid from the common fluid conduit.

12. The continuous pump system according to claim 9, wherein the two electrodes are flexible electrodes coated over at least a portion of the deformable shell.

13. The continuous pump system according to claim 9, wherein each two-stage pump of the plurality of two-stage pumps is configured to output an equal volume of the transfer fluid to the common fluid conduit at an equal pressure.

14. The continuous pump system according to claim 9, wherein the deformable shell comprises an electroactive polymer.

15. The continuous pump system according to claim 14, wherein the two electrodes are disposed within the deformable shell.

16. A multi-stage pump system using electrostatic actuators, the multi-stage pump system comprising:

a plurality of two-stage pumps coupled in a stacked series manner and configured to increase a pressure along a respective common fluid conduit, each two-stage pump of the plurality of two-stage pumps of the multi-stage pump system comprising:

a pair of hydraulically-amplified, self-healing, electrostatic (HASEL) actuators, each HASEL actuator of the pair of HASEL actuators in fluid communication with one another, and comprising:

a deformable shell defining a working fluid compartment;

a dielectric fluid disposed in the working fluid compartment; and two electrodes disposed on opposite sides of the deformable shell;

a first transfer conduit providing two-way fluid communication between the working fluid compartments of the pair of HASEL actuators;

a pair of fluid transfer bladders disposed adjacent the respective pair of HASEL actuators, each fluid transfer bladder configured for pumping a transfer fluid from an inlet to an outlet in fluid communication with the respective common fluid conduit, and comprising:

a fluid-impermeable membrane defining a transfer fluid chamber; and a biasing member disposed in the transfer fluid chamber; and a second transfer conduit providing selective fluid communication between the pair of fluid transfer bladders, wherein each two-stage pump of the plurality of two stage pumps is configured to output the transfer fluid to the respective common fluid conduit.

17. The multi-stage pump system according to claim 16, wherein a pressure of the transfer fluid in the respective common fluid conduit increases from 5% to 20% after passing each two-stage pump of the plurality of two-stage pumps.

18. The multi-stage pump system according to claim 16, comprising at least 8 two-stage pumps of the plurality of two-stage pumps coupled in a stacked series manner.

19. The multi-stage pump system according to claim 16, wherein each of the biasing members of the plurality of two-stage pumps have a spring constant associated therewith, wherein the spring constant increases sequentially in a flow direction of the multi-stage pump system.

20. The multi-stage pump system according to claim 16, configured to output the transfer fluid at a pressure of between 3 to 5 psi.

* * * * *